United States Patent [19]

Lubitzsch

[11] Patent Number: 4,951,660

[45] Date of Patent: Aug. 28, 1990

[54] DIVER'S RESCUE APPARATUS

[75] Inventor: Wolfgang Lubitzsch, Stockelsdorf, Fed. Rep. of Germany

[73] Assignee: Drägerwerk AG, Lübeck, Fed. Rep. of Germany

[21] Appl. No.: 166,732

[22] Filed: Mar. 2, 1988

Related U.S. Application Data

[63] Continuation of Ser. No. 924,356, Oct. 28, 1986, abandoned.

[30] Foreign Application Priority Data

Nov. 2, 1985 [DE] Fed. Rep. of Germany ..... 3538960

[51] Int. Cl.[5] ..... B63C 11/02

[52] U.S. Cl. ..... 128/201.27; 128/201.28; 128/202.14

[58] Field of Search ..... 128/201.27, 201.28, 128/202.14, 200.29, 201.29

[56] References Cited

U.S. PATENT DOCUMENTS 3,107,373 10/1963 Mellon, Jr. et al. ..... 128/201.27
3,524,444 8/1970 Ellard et al. ..... 128/201.27
3,845,768 11/1974 Garrahan ..... 128/201.27
4,108,171 8/1978 Nyman et al. ..... 128/202.14

FOREIGN PATENT DOCUMENTS 1097848 8/1962 Fed. Rep. of Germany .

*Primary Examiner*—Max Hindenburg
*Assistant Examiner*—J. P. Lacyk
*Attorney, Agent, or Firm*—McGlew & Tuttle

[57] ABSTRACT

A diver's rescue apparatus includes a fillable buoyancy element and a breathing bag into which respiratory gas mixture is metered from a compressed gas source is to be expanded to a range of use for greater diving depths, for example up to 150 to 200 m. It is to be possible to carry out the then necessary supply of the apparatus wearer with physiologically adapted respiratory gas mixtures varying during the ascent by simple means in order to minimize the space requirement and weight of the apparatus as well as its trouble proneness and cost of maintenance. A first compressed gas tank containing a gas mixture for great depths to the breathing bag via a fixed throttle 7, while a second compressed gas tank containing a gas mixture for small depths is so connected via a separate pressure reducer and a downstream second fixed throttle.

9 Claims, 2 Drawing Sheets

DIVER'S RESCUE APPARATUS

This application is a continuation of application Ser. No. 924,356, filed Oct. 28, 1986, now abandoned.

FIELD AND BACKGROUND OF THE INVENTION

The invention relates in general to diving equipment and in particular to a new and useful diver's rescue apparatus with a fillably buoyancy element and a breathing bag into which a respiratory gas mixture is metered from a compressed gas supply.

Such rescue apparatus is employed in particular for rapid ascent from damaged underwater craft whereby e.g. submarine crew members can come up from deep water. A buoyancy element provides the necessary buoyancy, a respiratory gas source supplying the ascending person with respiratory gas of suitable composition.

A known submarine rescue apparatus is described in G. Haux, Tauchtechnik (Diving Technology, German),. Volume 1, page 32, Berlin, Heidelberg, New York 1969. There, a respiratory gas mixture of for example 50% oxygen and 50% nitrogen is stored in a mixed-gas bottle under a maximum pressure of 200 kp/cm$^2$. The gas flows via a pressure reducer and a downstream throttle into the breathing cycle to which the wearer of the apparatus is connected via a mouthpiece. Exhalation takes place via a breathing bag, from which the exhaled air, purified via a $CO_2$ absorption cartridge is returned into the respiration cycle. In the known rescue apparatus, a constant inflow of the respiratory gas mixture takes place as a function of the diving depth to about 40 m. At greater depths, the inflow decreases noticeably due to the further increase of the counterpressure, and it stops entirely at a depth of about 80 m.

To be able to use the known rescue apparatus at still greater depths, the backpressure adjustment at the pressure reducer must be increased, so that the counterpressure at the greater depths can be overcome However, the apparatus wearer would then receive, also at great depths, a respiratory gas mixture with a physiologically unfavorable high oxygen partial pressure.

A known diving equipment according to German patent 10 97 848 has at least two compressed gas tanks containing oxygen and inert gas in different mixture ratios, the tanks being connected to a respiration cycle, in which equipment, depending on the diving depth, the admission of the respiratory gas mixture is established or interrupted. With this known apparatus, a respiratory gas mixture of higher oxygen content for small diving depths can be switched to a mixture of lower oxygen content for greater depths, and vice versa. For this purpose two pressure reducers and switches controlled by the water pressure are needed, which are arranged between the individual gas lines from the compressed gas tanks and the following header or collecting line. This results in a complicated layout, additional apparatus weight to be carried, and increased trouble proneness of the equipment as a whole, as it may occur through the existing proportioning mixing system.

SUMMARY OF THE INVENTION

The present invention provides a rescue apparatus which has capability of use for greater diving depths, for example up to 150 to 200 m. It is possible to supply the apparatus wearer with physiologically adapted respiratory gas mixtures varying during the ascent, by simple means so as to minimize the space requirement and weight of the equipment as well as its trouble proneness and cost of maintenance.

This problem is solved in that a first compressed gas tank containing a gas mixture for great diving depths is connected with a breathing bag via fixed throttle, while a second compressed gas tank containing a gas mixture for small depths is connected via pressure reducer and a downstream second fixed throttle.

The advantage of the invention resides essentially in that the apparatus wearer rising from great depths has available from the start both a gas mixture for great depths containing less oxygen (depth mixture)as well as a gas mixture for lesser depths containing more oxygen (altitude mixture) with which the breathing bag is continuously flushed during the ascent. The pressure reducer and the fixed throttles are adapted to each other in such a way that at first, at great depths, the depth mixture flows in predominant quantity from the respective compressed gas tank into the breathing bag. At the same time, an approximately mass-constant respiratory gas flow from the compressed gas tank containing the altitude mixture is adjusted via the pressure reducer and a following fixed throttle as a basic dosage with which a sufficient flushing of the breathing bag is obtained at depths between about 30 to 40 m and the surface. When rising from great depths, therefore, the apparatus wearer is first supplied with the depth mixture, the compressed gas tank discharging into the breathing bag as the ascent continues and the ambient pressure decreases. During the ascent, the gas delivery is reduced with decreasing tank pressure in accordance with the diminishing requirement, until the altitude mixture has taken over the supply of respiratory gas to the apparatus wearer. Thus, during ascent from great depths, there is supplied to the apparatus wearer the respiratory gas mixture physiologically favorable for him, without requiring any switching between the various mixtures to be done by him or occurring automatically.

The problem referred to can be solved also with a rescue apparatus in which there are connected with the breathing bag a first compressed gas tank containing a gas mixture for great depths via a fixed throttle, and a second compressed gas tank containing a gas mixture for small depths via the buoyancy element and a downstream blow-off valve.

Here the buoyancy element serves as intermediate storage for the altitude mixture from the respective compressed gas tank, which is evacuated into the buoyancy element when the ascent from great depths starts. The depth mixture flowing into the breathing bag then takes over the initial supply of the apparatus wearer with respiratory gas. With decreasing depth and decreasing ambient pressure, the altitude mixture stored in the buoyancy element expands, passes through the blow-off valve during the ascent, and thus contributes to the flushing of the breathing bag. With further decreasing depth the flushing with altitude mixture outweighs the percentage of depth mixture flowing into the breathing bag, so that the apparatus wearer can inhale during the entire ascent the physiological respiratory gas mixture favorable to him.

This additional embodiment of the invention has the advantage over the one set forth before that the filling of the buoyancy element occurs through the altitude mixture and hence a separate filling system for the buoyancy element can be dispensed with.

In a further development of the invention it may be advantageous to connect a supplementary valve in parallel with the throttle. It is thus possible to fill the breathing bag quickly with depth mixture immediately upon start of the ascent.

Appropriately a depth dependent switching element is placed ahead of the throttle. The response pressure of the switching element is chosen so that dosing of the depth mixture is interrupted as soon as the feed of altitude mixture into the breathing bag is sufficient for the respiratory gas supply. At the same time it is avoided that the depth mixture is breathed in the vicinity of the surface.

In especially advantageous manner the breathing bag is formed as a hood. It surrounds the head region of the apparatus wearer and is connected with the buoyancy element.

Accordingly it is an object of the invention to provide diver's rescue apparatus which comprises a fillable buoyancy element which may be filled with compressed gas having a breathing bag associated therewith which is supplied with a respiratory gas mixture which may be selectably connected to a first compressed gas tank which contains gas mixture for great depths and a second compressed gas tank which contains a mixture which is adapted to supply gas for lesser depths, and wherein the gas is supplied through a line having a fixed throttle in each case and in respect to the small depth supply also through a pressure reducer, and wherein the fillable buoyancy element may have an overpressure valve or a blow-off valve.

A further object of the invention is to provide an improved device for use by divers which includes an inflatable buoyancy element which is adapted to be engaged around the neck of a wearer and a hood which forms a breathing bag attached to the buoyancy element and extending around a person's head which includes means for providing the inflatable element with an inflatable material and the hood with variable breathing gas mixture adapted to the ascent of the person from a great depth.

A further object of the invention is to provide a diver's rescue apparatus which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
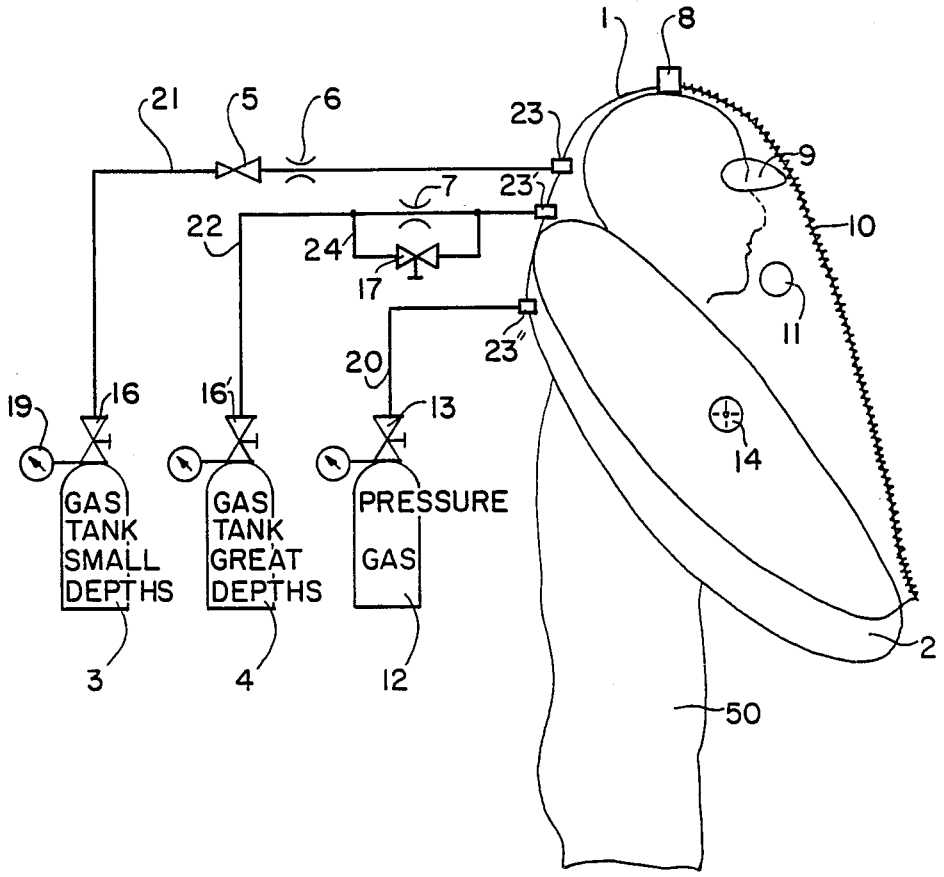
FIG. 1 is a schematic view of a diver's rescue apparatus constructed in accordance with the invention.

Referring to the drawings in particular the invention as embodied therein in FIG. 1 comprises a diver's rescue apparatus which includes a buoyant element 2 which may advantageously be in the form of a tubular member which fits over the head and engages around the neck of a diver 50. In accordance with the invention the buoyancy element 2 is associated with a breathing bag hood 1 which engages over the head of the wearer and it is advantageously provided with a viewing window 9 and a vent 11. In accordance with the invention, the hood is supplied with respiratory gas supplied from one or more tanks 3 or 4 which may be regulated in accordance with the depth at which the diver is initially exposed and in accordance with his ascent upwardly through the water depth to which he may be immersed.

The rescue apparatus illustrated in FIG. 1 has a buoyancy element 2 which hugs the shoulder/neck region of the wearer and is connected with a hood 1 which functions as breathing bag, the hood extending over the wearer's head. A pressure vessel 12 is connected to the buoyancy element 2 via a line connection 23" and a filling gas line 20. The interior of hood 1 is connected by an altitude mixture line 21 and a depth mixture line 22 to the respective compressed gas tank 3 containing the altitude mixture and to the compressed gas tank 4 containing the depth mixture . The tanks 3, 4 and 12 have bottle valves 13, 16 with a bottle pressure indication (pressure gauge)19. The altitude mixture line 21 has a pressure reducer 5, followed by a fixed throttle 6. In the depth mixture line 22 is a fixed throttle 7, which is bypassed by a supplementary valve 17 in the by-pass line 24.

In use, the rescue apparatus with its buoyancy element 2 is placed over the shoulder/neck region of the apparatus wearer, the hood 1 is pulled over his head and closed with the watertight zipper 10. Before surfacing, the buoyancy element 2 is pumped up by the pressure medium contained in the pressure vessel 12, excess gas being able to escape from the overpressure valve 14. As the pressure medium is not inhaled, it may be, for example $CO_2$ stored in liquid form. To supply the interior of hood 1 with respiratory gas mixture, the valves 16 and 16' are opened, and because of the higher pressure in the compressed gas tank 4 predominantly depth mixture is introduced into the hood at first. For rapid filling of the hood interior, the supplementary valve 17 may be opened. Together with the depth mixture there flows through the altitude mixture line 21 a basic dosage of altitude mixture which is determined by the adjustment of the pressure reducer 5 and the following fixed throttle 6.

The filling pressure in the compressed gas tanks 3 and 4, the oxygen component in the altitude mixture and in the depth mixture, as well as the dosing of the two gas mixtures are matched so that when rising from great depths the oxygen partial pressure in the interior of hod 1 corresponds to the physiologically permissible values. With increasing ascent the proportion of depth mixture in hood 1 decreases and the proportion of altitude mixture increases. The surplus respiratory gas mixture supplied can be given off to the environment via an overpressure valve 8. The overpressure is adjusted so that the height of the gas bubble in hood 1, measured in the water, is about 30 cm in the direction of ascent. The overpressure valve 8 may be dispensed with if there is provided at the bottom of hod 1 a blow-off opening through which the respiratory gas can flow off freely. At the surface, the apparatus wearer can open a vent 11, to allow respiration of open air. A window 9 permits vision through the closed hood 1.

Figure 2:
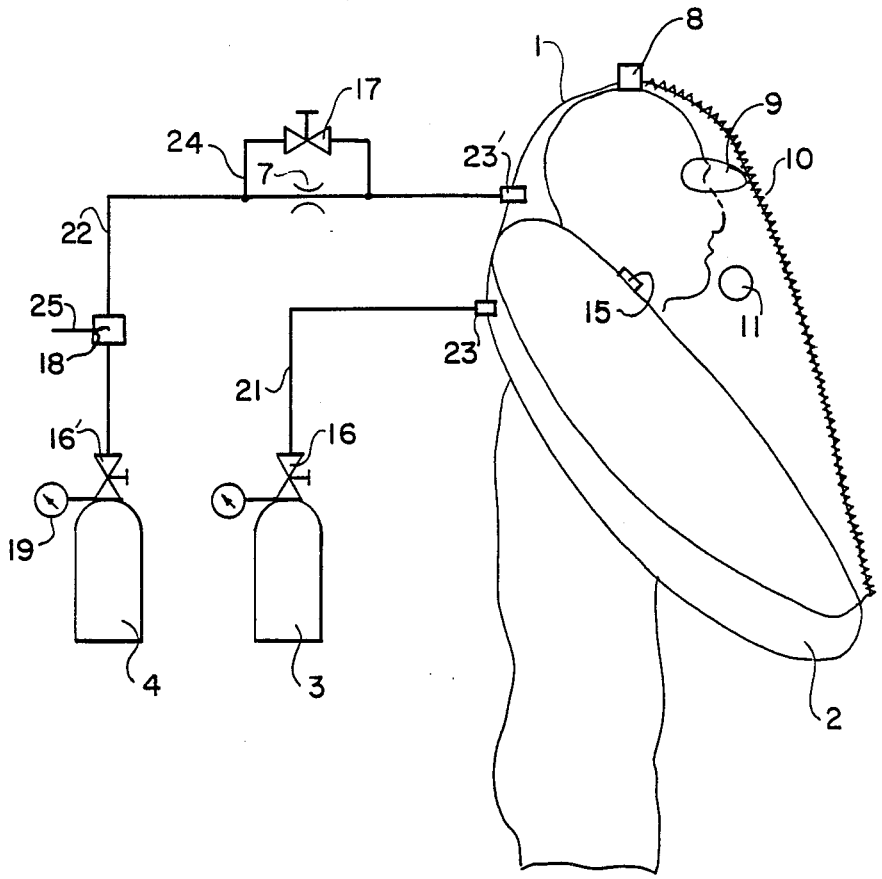
FIG. 2 is a view similar to FIG. 1 of a modified diver's rescue apparatus.

In FIG. 2, a diver's rescue apparatus is illustrated, the hood 1 of which is connected via the line connection 23' and the depth mixture line 22 to the compressed gas tank 4 containing the depth mixture. The altitude mixture line 21 discharges into the buoyancy element 2 via the line connection 23. Before the start of ascent from great depths, the apparatus wearer with the rescue apparatus applied opens the valve 16 and fills the buoyancy element 2 with the content of the compressed gas tank 3. At the same time the bottle valve 16' at the compressed gas tank 4 opens, so that the depth mixture flows in sufficient quantity into the hood 1. With increasing height of ascent and simultaneously decreasing ambient pressure, the altitude mixture contained in the buoyancy element 2 expands. An overpressure adjustable at the blow-off valve 15 having been reached, the latitude mixture escapes from the buoyancy element 2 and enters the hood 1. Due to the mixing of the depth mixture with the altitude mixture, the oxygen proportion of the gas mixture contained in the hood 1 increases. With further increasing height of ascent the proportion of the altitude mixture predominates due to the increasing expansion of the gas volume in the buoyancy element 2, until in the end only altitude mixture is available in hood 1. A switch 18, provided with a pressure sensitive sensor 25 shuts the depth mixture line 22 off as soon as a diving depth is reached at which enough altitude mixture is supplied due to the expansion and further breathing of depth mixture is undesirable.

The above described process apply to ascent from great diving depths. In case of an ascent from little depth, the compressed gas tank 4 containing depth mixture remains closed.

While specific embodiments of the invention have been shown and described in detail to illustrate the application of the principles of the invention, it will be understood that the invention may be embodied otherwise without departing from such principles.

What is claimed is:

1. A diver's rescue apparatus comprising a fillable buoyancy element, a breathing bag exposed to ambient pressure attached to said fillable buoyancy element, a respiratory gas mixture system connected to said breathing bag including a first compressed gas tank containing a gas mixture for great depths and second compressed gas tank containing a gas mixture suitable for lesser depths, a first connecting line from said first compressed gas tank to said breathing bag having a first fixed throttle, a second connecting line from said second compressed gas tank to said breathing bag, the second connecting line having a pressure reducer reducing the pressure of the gas mixture supplied to the breathing bag from the second tank to below the pressure of the gas mixture supplied to the breathing bag from the first tank, and, a second fixed throttle in the second connecting line whereby, throughout operation of the rescue apparatus, ignoring any depletion of the gas supply, the difference between the pressures of the gas mixtures supplied from the first and second tanks is constant so that the quantities of gas mixture flowing from respective tanks into the breathing bag are determined substantially entirely by the ambient pressure to which the breathing bag is exposed.

2. A diver's rescue apparatus according to claim 1, including a supplementary line having ends connected to said first connecting line before and after said first fixed throttle so that the supplementary line bypasses said first fixed throttle, the supplementary line having a supplementary valve therein.

3. A diver's rescue apparatus according to claim 1, wherein said breathing bag comprises a diver's hood.

4. A diver's rescue apparatus according to claim 1 in which valve means are connected to the buoyancy element through which valve means the buoyancy element can be filled.

5. A diver's rescue apparatus comprising a fillable buoyancy element, a breathing bag connected with said fillable buoyancy element, a respiratory gas mixture system connected to said breathing bag including a first compressed gas tank containing a respiratory gas mixture for great depths and a second compressed gas tank containing a respiratory gas mixture for smaller depths, a first connecting line from said first tank to said breathing bag having a first fixed throttle, and a second connecting line from said second compressed gas tank to said buoyancy element, said buoyancy element having a blow-off valve connecting said buoyancy element with said breathing bag.

6. A diver's rescue apparatus according to claim 5, including a depth dependent switching element located in said first connecting line.

7. A diver's rescue apparatus, according to claim 5, wherein: said blow-off valve is responsive to a predetermined pressure of said respiratory gas mixture for smaller depths in said buoyancy element, so as to allow said respiratory gas mixture for smaller depths to enter said breathing bag when said respiratory gas mixture for smaller depths in said buoyancy element expands.

8. A diver's rescue apparatus, comprising: an inflatable buoyant tubular member engageable over a diver's head and on the diver's shoulders; a hood engaged around the periphery of said inflatable buoyant tubular member and adapted to be brought into engagement over the head of the diver, said hood being inflatable so as to be filled with respiratory gas, the pressure of respiratory gas within said hood being a function of the pressure exterior of said hood; a respiratory gas mixture system connected to said hood including a first compressed gas tank containing a gas mixture for great depths and a second compressed gas tank containing a gas mixture suitable for lesser depths, a first connecting line from said first compressed gas tank to said hood having a first fixed throttle means for delivering the respiratory gas to said hood depending upon the pressure in said first compressed gas tank; a second connecting line from said second compressed gas tank to said hood having a fixed throttle for delivering the respiratory gas to said hood depending upon the pressure in said second compressed gas tank and the pressure in said hood.

9. A diver's rescue apparatus according to claim 8, wherein: said second connecting line connects said second compressed respiratory gas tank to said hood through said buoyant tubular member, said buoyant tubular member including a blow-off valve allowing gas to flow from said second compressed gas tank to said buoyant tubular member and into said hood when there is a decrease in ambient pressure.

* * * * *